United States Patent [19]

Holman

[11] 4,136,524

[45] Jan. 30, 1979

[54] APPARATUS FOR SEALING ACCESS HOLES TO CAVITIES WITHIN THE EARTH WITH ROCK GLASS

[75] Inventor: Robert R. Holman, Bethel Park, Pa.

[73] Assignee: Westinghouse Electric Corp., Pittsburgh, Pa.

[21] Appl. No.: 740,685

[22] Filed: Nov. 10, 1976

[51] Int. Cl.[2] ..... E02D 3/08

[52] U.S. Cl. ..... 405/131

[58] Field of Search ..... 61/36 A, 35 R, 63, 0.5; 13/DIG. 1; 166/288; 299/14

[56] References Cited

U.S. PATENT DOCUMENTS

| | | | |
|---|---|---|---|
| 1,361,282 | 12/1920 | Nolan | 61/36 A |
| 3,774,701 | 11/1973 | Weaver | 61/36 A X |
| 3,800,875 | 4/1974 | Hardy et al. | 166/288 |

*Primary Examiner*—Jacob Shapiro

*Attorney, Agent, or Firm*—D. C. Abeles; Z. L. Dermer

[57] ABSTRACT

Apparatus for establishing a solid, very low permeable rock glass plug to seal access holes through rock to underground storage vaults. The apparatus is designed to supply a filler material having a constituency substantially matching that of the rock formation surrounding the access port to the vault, through a central feeder tube under pressure to the vault. Means are provided for heating the filler material and surrounding rock formation at the point where the filler material exits the feeder tube, to a temperature sufficient to melt both the rock formation and the filler material. The remaining portion of the feeder tube is cooled to preserve the surrounding rock formation spaced from the feeder orifice. The melt at the extremity of the feeder tube is forced through the orifice to a region below the tool by the force of the pressure feed. As the melt is forced below the tool, the tool is retracted until the access hole is completely sealed.

A second embodiment is provided to seal enlarged openings which further includes a cooled core follower that enables the deposit to be fused in layers closing in the circumference of the hole until a final pass fuses the central core.

7 Claims, 2 Drawing Figures

APPARATUS FOR SEALING ACCESS HOLES TO CAVITIES WITHIN THE EARTH WITH ROCK GLASS

BACKGROUND OF THE INVENTION

This invention pertains generally to sealing access ports to vaults within the earth's surface and more particularly to such apparatus that provides a fused seal integral with the rock formation surrounding the port.

Deep holes and natural salt deposits have been identified as the most promising places to dispose of radioactive waste. This is contingent, however, on providing a good seal for the storage region. A means is desired to assure that the water seepage and damage would be as effectively impeded after access to the storage vault as before opening. The most viable means would be to end up with the identical over-burden and earth/rock covering formations that had existed before being breached by drilling.

Accordingly, means are desired for establishing almost an equivalent rock/earth condition which is redoposited in a fully integrated manner to form an effective seal.

SUMMARY OF THE INVENTION

Briefly, this invention satisfies the desired criteria for establishing an effective seal for storage vaults by providing apparatus for depositing molten earth/rock in a rock glass form that fully fuses with the surrounding materials. The apparatus generally includes an elongated outer tubular member which is sized to extend longitudinally within the vault below the exterior of the surface of the rock formation surrounding the vault's cavity. An inner tubular member is secured substantially coextensive and concentric with and spaced from the outer tubular member with the space between the outer and inner tubular members defining an open annulus which is hermetically closed at the one end to be extended within the vault's cavity. Means are provided for heating the interior of the inner tubular member adjacent the extended end to a temperature sufficient to melt the rock formation of the cavity. In addition, means are provided for feeding gravel of substantially the same constituency as the rock formation through the interior of the inner tubular member under pressure to the exterior of the extended end. As the gravel approaches the port to the exterior of the extended end, it is melted along with the surrounding cavity's rock formation and fused thereto as the apparatus is withdrawn from the cavity.

To accommodate vaults having extremely large openings wherein it is desirable to establish the seal in layers to assure a fully fused and integrated over-burden, the apparatus of this invention is provided with a third tubular member secured substantially concentrically within, coextensive with and radially spaced from the inner tubular member with the radial spacing between the inner tubular member and the third tubular member sized to permit the flow of the gravel therethrough. A fourth tubular member is secured substantially coextensive with, concentrically within and spaced from the third tubular member with the space between the third and fourth tubular members defining an open annulus which is hermetically closed at the one end to be extended within the cavity. Further, additional means are provided for heating the interior of the third member adjacent the extended end to a temperature sufficient to melt the rock formation; and the means for feeding gravel is modified to feed the gravel through the annulus between the inner and third tubular member.

Thus, an almost equivalent rock/earth condition can be re-established with this invention with the overburden redeposited in a fusible, fully integrated manner from a molten condition.

BRIEF DESCRIPTION OF THE DRAWINGS

For a better understanding of the invention, reference may be had to the preferred embodiment, exemplary of the invention, shown in the accompanying drawings, in which.

DESCRIPTION OF THE PREFERRED EMBODIMENT

As explained previously, the most desirable means of sealing such storage vaults is to establish the identical over-burder and earth/rock covering formation that had existed before being breached by drilling. An almost equivalent rock/earth condition can be re-established if the rock/earth is redeposited in a fusible, fully integrated manner, such as from a molten condition. Characteristics in this case would be equally or better developed from the standpoint of impermeability and fusing with the parent surrounding materials.

This invention provides apparatus which can deposit molten earth/rock in a rock glass form that fully fuses with the surrounding materials. Characteristics of the rock glass formation which result have been identified experimentally and show that nearly equivalent densities and lower permeabilities than the parent materials are possible. The apparatus of this invention can be analogized to a welding device having the capability of melting and pressure back filling the opening of an underground storage vault. The apparatus permits material reconstructing, with nearly identical constituencies, and tailoring of the "weld" as needed to obtain the desired plug characteristics. This is in contrast to conventional hole plugging methods which use earth/rock packing or cementing medias.

Figure 1:
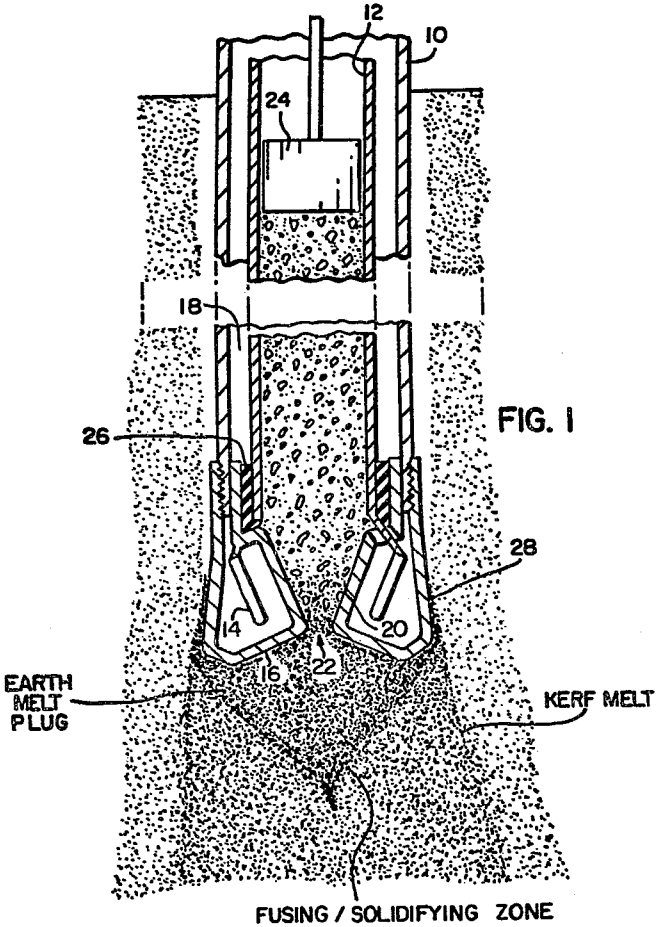
FIG. 1 is a sectional view of one embodiment of this invention.

The basic system components of this invention are illustrated in FIG. 1 which shows a vertical section of a thermal melting/refill tool constructed in accordance with the principles of this invention. Electrical energy in this particular embodiment is transmitted through the structure of a tubular position/retriever member 10 and returned through an inner tubular feed member 12 after energizing a resistant heating element 14 within the coupling heating unit 16. The coupling unit 16 hermetically seals the extended end of an annular cavity 18 formed between the inner and outer tubular members 12 and 10. The cavity 18 acts as a passage for cooling gas as will be explained hereinafter.

The heat generated by the heating element 14 is transmitted to the receptor 20 which in this case is the melt forming structure and hence to the material to be melted and the melt. The melt is forced through the orifice 22 to the region below the tool by the force produced from pressure applied to a feed ram 24. As the melt is forced below the tool, the tool is retracted. This is accomplished both by the melt pressure and control of the movement of the position/retriever tube 10.

Coolant and utilities such as inert gas, control cables and instrumentation are provided through the annulus 18 formed between the position/retriever tube 10 and the feed tube 12. An inert gas environment for the heater area within the coupler 16 is maintained at a pressure sufficient to assure that no cooling air or melt will enter. Insulation 26 is maintained above the heater sections to prevent melting outside of the weld area.

The granular constituency of the feed material is sized to establish enough surface area to achieve melt within the area of the heater without undue flow through the orifice 22 in other than a molten state. The peripheral design of the heater section is gauged to melt the surrounding rock formation to establish an integral joint. Thus, the apparatus of this invention may be analogized to a hot wire tungsten welding system with the feed section corresponding to the hot wire torch and the exterior section of the heat coupling unit 16 corresponding to the tungsten welding torch.

It is desirable that the heat coupler element 16 be maintained within proximity of the exterior access hole surface to assure the undisturbed rock will fuse properly with the filler material. It is also desirable to cool the retriever/positioner tube surface above the heating area to assure that the access hole undisturbed rock surface within vicinity of the positioner/retriever tube outer surface does not melt out of range of the heating element as it is retracted. An inert cooling gas is fed through the annulus 18 for this purpose. In addition, the heat coupler element 16 can be spring-biased against the access hole wall to assure proper thermal conduction.

For small vault access holes, cooling is only required for a few vital parts of the tool stem above the melting-/refill assembly. For larger holes, cooling of the glass plug is desirable to insure an integral covering. Just as in the welding of large grooves where a number of passes are employed to fill the groove, a rock glass plug for larger holes is deposited in layers over several passes using a cooled core follower extending through the melting/refill tool as depicted in FIG. 2.

Figure 2:
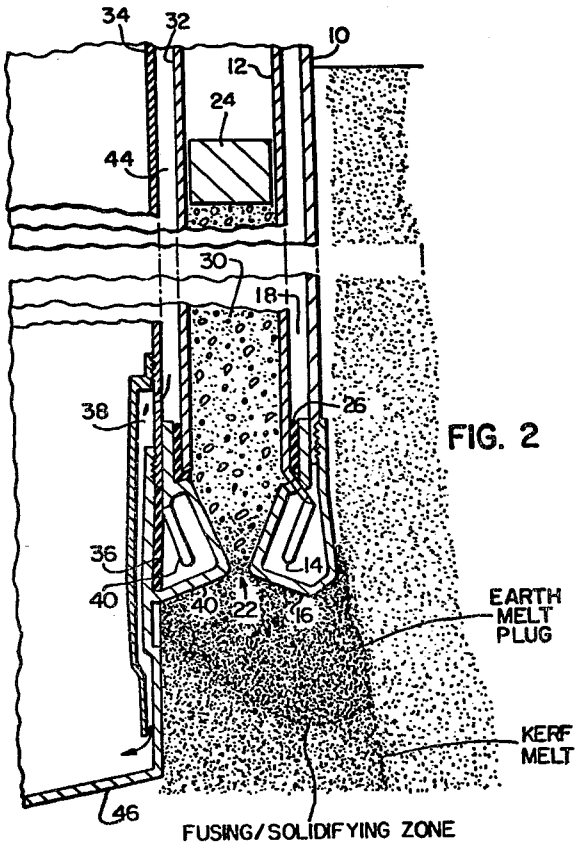
FIG. 2 is a quarter sectional view of a second embodiment of this invention.

FIG. 2 illustrates a second embodiment of this invention for back filling in layers. The same reference characters have been employed on corresponding parts to that shown in FIG. 1 for the purpose of comparison. The embodiment of FIG. 2 can in part be considered an enlarged counterpart of that shown in FIG. 1 with the addition of two concentric inner tubular members 32 and 34 positioned coextensive with the outer tubular members 10 and 12. An annular cooling port 44 is defined by the space between the tubular members 32 and 34 similar to the cooling port 18. The port 44 is provided with an additional annulus 38 which routes the cooling gas through an extended wall of the member 34. The extended portion 36 of the tubular member is provided to cool each layer as it is deposited. A heating element 40 and coupler section 42 is provided similar to the heating element 14 and coupler 16 of the outer section defined by the members 10 and 12. In this particular embodiment the feed ram and the filler material feed section are annular in shape. The tool functions in the same manner as that of FIG. 1 depositing the plug in layers. A series of such tools are successively used until the hole size is amenable to complete fill with the embodiment of FIG. 1 without significant problems from heat dissipation to the surroundings.

Natural salt deposits have been determined as the most promising place to dispose of radioactive waste provided, that after the deposits are breached by drilling to create the storage vault, water is prevented from penetrating the salt regions. This is mainly because the salt deposits have been undisturbed for millions of years inasmuch as they are at depths where surface effects and natural forces at the earth surface do not reach. In addition, salt deposits are located in stable, stratified regions typified by slow gradual deformations and not subject to earthquakes, etc., that could breach the protecting sedimentary rock covering. In addition, salt is a natural material capable of rapid plastic deformation that maintains its integrity, actually "healing" any fractures that might happen. Most important, salt formations are large and resistant to damage by heat, radiation and many other factors with the exception of water. Therefore, it is highly important to assure that the water seepage and damage would be as effectively impeded after access to the salt vaults as before opening them. Thus, this invention provides the means to recreate substantially the identical over-burden and rock covering formation that had existed before opening of the vault. Where special properties are desired with respect to specific plugs, the filler material can be "doped", i.e., by the addition of water, if needed to establish the desired characteristics. Accordingly, breached access ports to storage vaults can be sealed by the apparatus of this invention with at least the integrity of the original over-burden.

I claim as my invention:

1. Apparatus for fusing and sealing a cavity within a rock formation comprising:

an elongated outer tubular member sized to extend longitudinally within the cavity below the exterior surface of the rock formation surrounding the cavity;

an inner tubular member secured substantially coextensive and concentric with and spaced from the outer tubular member with the inner tubular member being inwardly tapered at one end to be extended within the cavity to form an orifice having a predetermined diameter, the space between the outer and inner tubular member defining an open annulus which is hermetically closed at the extended end;

means for heating the interior of the inner tubular member adjacent the extended end to a temperature sufficient to melt the rock formation; and means for feeding gravel of substantially the same constituency as the rock formation through the interior of the inner tubular member under pressure to the exterior of the extended end wherein the predetermined diameter of the orifice of the inner tubular member is sized to control the feed of gravel to the exterior of the extended end to a rate which will enable gravel melt within the interior of the inner member.

2. The apparatus of claim 1 including means for cooling the surface of the outer tubular member over a longitudinally extended section spaced from the heating means.

3. The apparatus of claim 1 wherein the means for heating comprises a resistance heating element disposed within the open annulus adjacent the extended end in heat transfer communication with the interior of the inner member and the exterior of the outer member.

4. The apparatus of claim 3 wherein a portion of the annulus housing the heating element is hermetically sealed and filled with an inert gas.

5. The apparatus of claim 1 including: a third tubular member secured substantially concentrically within, coextensive with and radially spaced from the inner tubular member with the radial spacing between the inner tubular member and third tubular member sized to enable the flow of the gravel therethrough;

a fourth tubular member secured substantially coextensive with, concentrically within and spaced from the third tubular member, the space between the third and fourth tubular members defining an open annulus which is hermetically closed at the one end to be extended within the cavity;

means for heating the interior of the third member adjacent the extended end to a temperature sufficient to melt the rock formation; and wherein the means for feeding gravel feeds the gravel through the annulus between the inner and third tubular member.

6. The apparatus of claim 6 including means for cooling the fourth tubular member.

7. The apparatus of claim 7 wherein the fourth tubular member extends substantially axially beyond the third tubular member to cool the melt layer as it is deposited.

* * * * *